United States Patent [19]

Crawford

[11] Patent Number: 4,682,657

[45] Date of Patent: Jul. 28, 1987

[54] METHOD AND APPARATUS FOR THE RUNNING AND PULLING OF WIRE-LINE TOOLS AND THE LIKE IN AN OIL OR GAS WELL

[76] Inventor: James B. Crawford, P.O. Box 30636, Lafayette, La. 70503

[21] Appl. No.: 910,418

[22] Filed: Sep. 22, 1986

Related U.S. Application Data

[62] Division of Ser. No. 701,572, Feb. 14, 1985, Pat. No. 4,612,984.

[51] Int. Cl.[4] ..... F213 17/20

[52] U.S. Cl. ..... 166/385; 166/77

[58] Field of Search ..... 166/77, 384, 385, 311, 166/312, 301, 98, 99; 175/71

[56] References Cited

U.S. PATENT DOCUMENTS

| | | | |
|---|---|---|---|
| 3,401,749 | 9/1968 | Daniel | 166/384 |
| 3,724,567 | 4/1973 | Smitherman | 166/77 X |
| 3,791,447 | 2/1974 | Smith et al. | 166/384 X |
| 4,091,867 | 5/1978 | Shannon, Jr. et al. | 166/77 |
| 4,518,041 | 5/1985 | Zublin | 166/312 |
| 4,612,984 | 9/1986 | Crawford | 166/77 |

*Primary Examiner*—Stephen J. Novosad
*Assistant Examiner*—David J. Bagnell
*Attorney, Agent, or Firm*—Pravel, Gambrell, Hewitt, Kimball & Krieger

[57] ABSTRACT

A method for running tools in an oil or gas well includes the running of an elongated small diameter tubing string from a coil stored on a reel down into the oil and gas well. A fluid conveying carrying tool is secured to the lowermost distal end portion of the coil tubing string so that fluid can circulate from the coil tubing wound upon the reel into a tool assembly. Fluid (or pressurized gas) can be introduced into the well through the tubing so that it circulates through the tubing and then into the tool carrier. A tool such as a wire-line tool is supported by the tool carrier so that pinching can be applied to the tool with the coil tubing string with the tool carrier forming a load transfer interface between the coil tubing string and the wire-line tool.

7 Claims, 8 Drawing Figures

METHOD AND APPARATUS FOR THE RUNNING AND PULLING OF WIRE-LINE TOOLS AND THE LIKE IN AN OIL OR GAS WELL

This is a division of application Ser. No. 701,572, filed Feb. 14, 1985 entitled "Apparatus for the Running and Pulling of Wire-line Tools and the Like in an Oil or Gas Well, now U.S. Pat. No. 4,612,984.

BACKGROUND OF THE INVENTION

1. Field of the Invention

The present invention relates to coil tubing units and to a method and apparatus for the running of various tools having hollow internal bores on a coil tubing unit where solid measuring wire-line equipment cannot adequately perform because of an accumulation of sand and/or debris, and/or the requirement of additional pulling capacity that is unavailable with a conventional wire-line.

2. General Background

There are various devices which are used to "service" an oil or gas well. These service applications can include the running or pulling of safety valves and gas lift valves, the running plugs in the well and setting them, washing sand and debris off wire-line tools, opening and closing sliding side doors, and cutting parafin. In some cases however, a solid "wire-line" can not be used to service a well because of the accumulation of debris or sand or the line does not have the strength of a coil tubing unit necessary to pull a given device from the well. Typical workover units or snubbing units which might approach a solution to the problem which the present invention solves are extremely expensive to operate.

The use of coil tubing units in general can be seen, for example, in U.S. Pat. No. 3,791,447 issued to Arthur Smith, et al. entitled "Well Methods for Sand Bridge Removal Using Small Diameter Tubing," and U.S. Pat. No. 3,722,594 issued to Arthur Smith, et al. entitled "Well Methods Using Small Diameter Tubing," incorporated herein by reference. Coil tubing units are commercially available and sold by a number of manufacturers such as, e.g. by Hydra Rig, Incorporated of Fort Worth, Tex. A patent relating to the use of wire-line tools can be seen in the Daniel U.S. Pat. No. 3,401,749 entitled "Method and Apparatus for Moving Wire-line Tools Through Deviated Well Bores." Other possibly pertinent prior art considered with respect to this invention includes, for example, the following U.S. patents.

| U.S. Pat. No. | Inventor | Invention | Issue Date |
|---|---|---|---|
| 3,554,284 | Nystrom, H. | "Methods for Facilitating The Descent of Well Tools Through Deviated Well Bores" | 01/12/71 |
| 4,082,144 | Marquis, G. | "Method and Apparatus for Running and Retrieving Logging Instruments in Highly Deviated Well Bores" | 04/04/78 |
| 3,727,693 | Tausch et al. | "Method and Fluid System For Moving Subsurface Well Equipment in Well Tubing" | 04/17/73 |
| 3,040,808 | Schramm et al. | "Method and Apparatus for Perforating Oil Wells" | 06/26/62 |
| 3,830,304 | Cummins, A. | "Wellhead Isolation Tool and Method of Use Thereof" | 08/20/74 |
| 3,658,126 | Bohlmann, et al | "Servicing Wells" | 04/25/72 |
| 3,312,282 | E. D. Yetman | "Pumping Well Tools Through Flowlines of Irregular Diameter" | 04/04/67 |
| 3,363,880 | L. Blagg | "Cable-Feeding Apparatus" | 01/16/68 |
| 3,401,749 | W. L. Daniel | "Method and Apparatus for Moving Wire-Line Tools Through Deviated Well Bores" | 09/17/68 |
| 3,675,718 | Kanady, W. | "Conducting Operations In A Well Through A Normally Closed Valve" | 07/11/72 |
| 2,810,442 | Tausch, G. | "Flexible Tubular Extension Member for Wells" | 10/22/57 |

The above patents relate generally to coil tubing units or to wire-line units or wire-line tools and do not solve the problem of running tools such as carrying tools, pulling tools, fishing tools, jars and the like with a coil tubing unit.

To solve this problem, and to satisfy the above described applications, a coil tubing unit with the pipe having an exemplary minimum line pull of 14,000 lbs. and a maximum of 20,000 lbs. can be used as specified herein with a special carrying tool to "run" hollowed tools with internal flow bores into the well. The coil tubing unit can thus perform several desirable functions such as: (1) wash debris and sand from the well to the "fishing neck" or "stuck" wire-line tools; (2) allow continuous circulation while jarring or pulling a particular wire-line apparatus; and (3) allow continuous circulation and thus equalized pressure when removing safety valves from the well (such as surface-controlled wire line retrievable tubing safety valves, as e.g. OTIS model DS, DK, DR "STORM CHOKES"). In the removal of such safety valves that are "stuck" the coil tubing unit can provide much greater pulling capacity than a wire-line, saving the use of a more expensive workover rig or snubbing unit if the wire-line unit cannot retrieve the valve. If the wire-line cannot relieve such a "stuck" valve (or like tool), a snubbing unit or workover rig must be used to remove the "stuck" tool or valve. Fishing necks on such valves or tools can be grabbed with an off/on overshot or releaseable spear such as manufactured by Baker Oil Tools. These tools are hollowed with an internal bore to allow for circulation.

Other tools which can be pulled or run with the method and apparatus of the present invention include for example, jars, all runnings tools, all pulling tools. Applications using this method and apparatus include: (1) washing sand and debris off wire-line tools and fishing tools; (2) washing down to plugs and pulling them; (3) running plugs in the well and setting them; (4) opening and closing sliding side doors; (5) running and pulling chokes; (6) running and pulling gas lift valves; (7) cutting parafin; and (8) running and pulling safety valves.

GENERAL DISCUSSION OF THE PRESENT INVENTION

The present invention provides a method and apparatus for pulling or running hollowed, internal bore tools that are typically used to retrieve or run "wire-line" tools and the like on a coil tubing unit. The method of the present invention includes the use of an elongated small diameter tubing string which is stored on a reel in a coil. The tubing can have a 0.090 inch wall thickness, for example. The lower distal end portion of the coil tubing forms a connection with a fluid conveying tool carrier which is mounted on the distal end portion of the coil tubing string so that fluid can circulate from the coil tubing on the reel through the coil tubing which is extended into the well bore and then into the tool carrier. Pressurized gas can be introduced into the well through the coil tubing and then through the tool carrier so that it can circulate into the well through a particular tool used to pull or run wire-line equipment including but not limited to wire-line tools. In this manner, tension can be applied to the tool with the coil tubing string that far exceeds the tension that can be applied with a wire-line.

In the preferred embodiment, the tool which is carried by the carrier is a pulling or running tool which is hollowed with an internal bore. The tool would preferably have a bore through which fluid can circulate that communicates by fluid circulation through the tool carrier. The tool preferably includes mechanical means operable by tension or compression applied through the coil tubing string for forming a connection with an object that has become at least temporarily lost in the well. The coil tubing string can, for example, be thrust into the well by an injection head with pipe feed by rotation of the reel. The tool can be, for example, a typical wire-line tool or a hollowed overshot. Removal of the tool from the well is produced by the injector head on the coil tubing unit so as to move the tool through the wall.

The aforedescribed method allows the pumping of pressurized fluid through the coil tubing unit to the carrying tool and into the hollowed wire-line tool which is attached to aid in moving the tool through any material which might be accumulated in the well. Circulation solves a problem which plagues typical wire-line tools, namely sand accumulation atop the tool which will not allow solid wire-line or wire-line tools to go down into the well.

The apparatus of the present invention includes a carrying tool for supporting hollowed, internally bored wire-line tools with a coil tubing unit which is wound upon a continuation length of coil tubing. The apparatus includes an elongated tool body having a flow bore for circulating fluid through the tool which communicates with an opening on the upper end of the tool so that one end of the length of tubing of the coil tubing unit can enter the bore. A connection within the bore forms a connection between one end of the coil tubing and the tool body and includes a load transfer surface that is spaced linearly along the tube bore and a corresponding length of coil tubing end that occupies the tube bore. A wire-line tool carrying means is formed on the lower end portion of the tool for supporting a wire-line tool with the coil tubing unit. The apparatus as described can "run" many varied tools referred to heretofore as wire-line tools, but that have been bored to allow.fluid circulation such as jars, accelerators, off/on overshots, jar pulling tools and all related fishing or wire-line tools which gives the present method greater jarring action of the tool in the well than conventional methods and several thousand pounds or greater pulling strength than wire-line.

BRIEF DESCRIPTION OF THE DRAWINGS

For a further understanding of the nature and objects of the present invention, reference should be had to the following detailed description, taken in conjunction with the accompanying drawings, in which like parts are given like referenced numerals and wherein.

DETAILED DESCRIPTION OF THE PREFERRED EMBODIMENT

Figure 1:
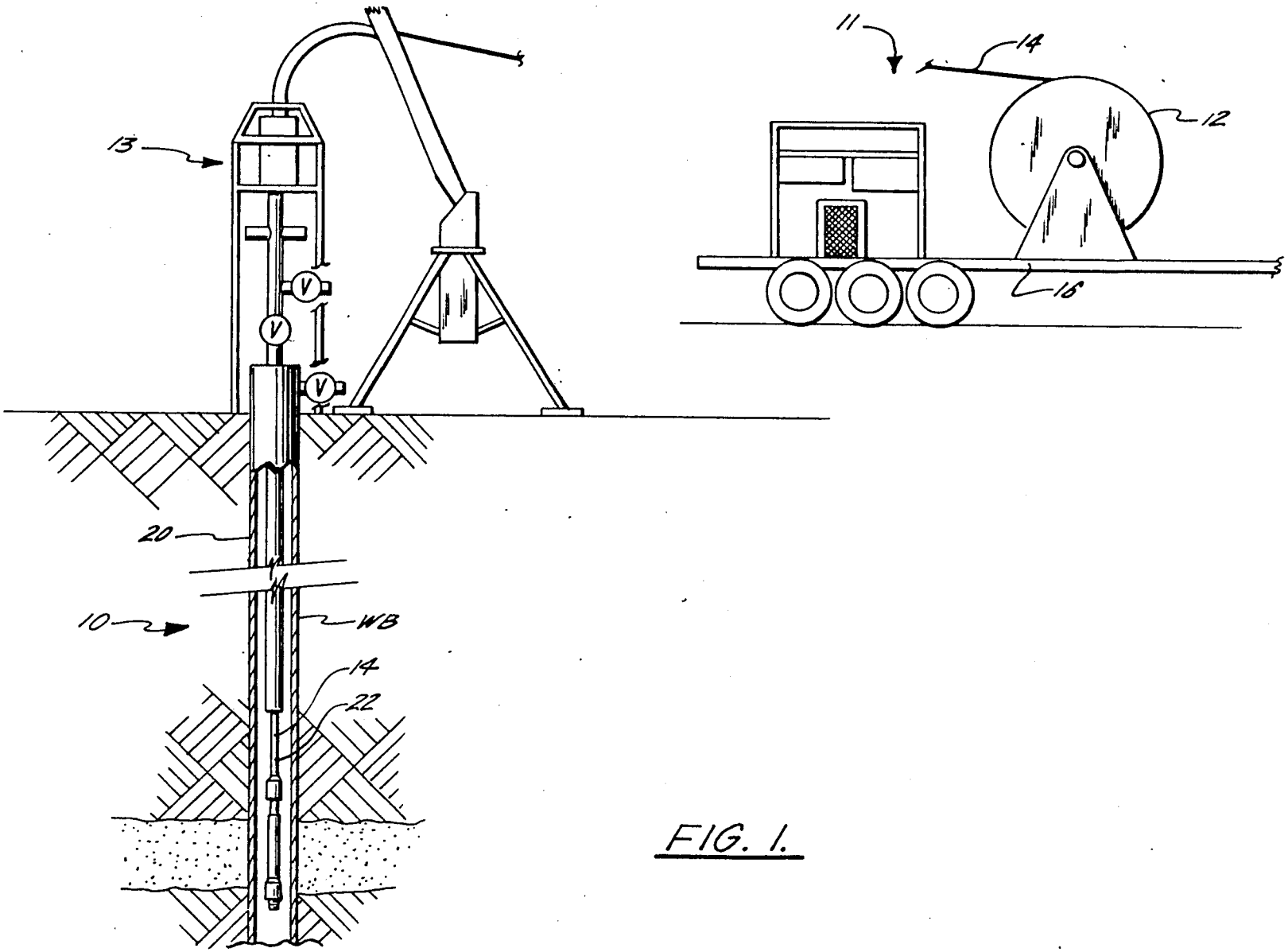
FIG. 1 is an elevational schematic view of the preferred embodiment of the apparatus of the present invention illustrating the coil tubing unit, the well bore, and the tool carrier during use.
Figure 2:
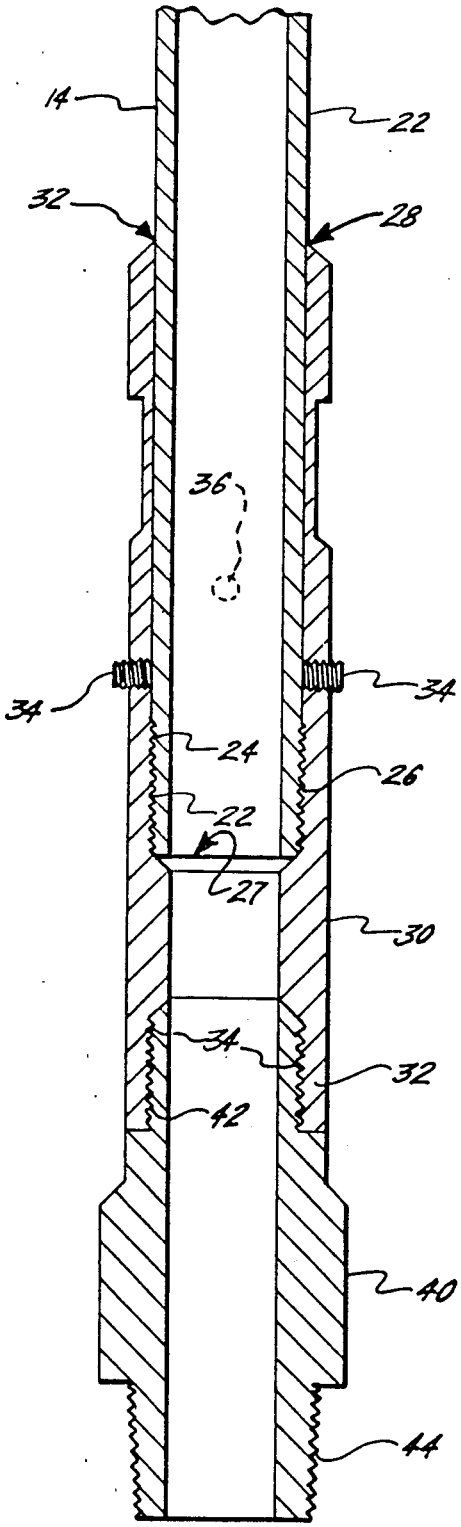
FIG. 2 is a sectional elevational view of the preferred embodiment of the apparatus of the present invention illustrating the tool carrier as attached to the lower distal end portion of the coil tubing unit and the coil tubing string.
Figure 3:
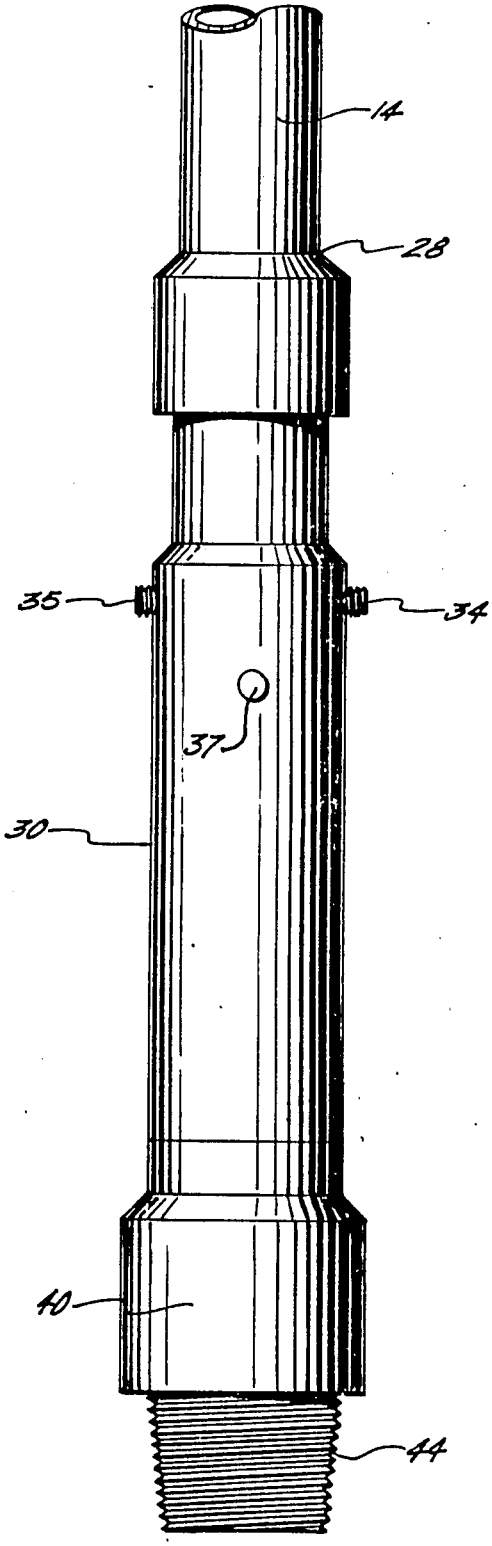
FIG. 3 is a front view of the preferred embodiment of the apparatus of the present invention illustrating the tool carrier.

FIGS. 1–3 generally indicate the preferred embodiment of the apparatus of the present invention designated generally by the numeral 10.

In FIG. 1 there can be seen a coil tubing unit 11 that includes a reel 12 having a length of coil tubing 14 wound upon the reel and skid mounted for use on land or offshore. An injector head 13 forces the tubing 14 into the well bore WB. In FIG. 1, 16 generally indicates such a carrier for reel 12. The reel 12 is supported by a foundation 15 mounted upon the top of bed 16. Tubing 14 can be run into a well bore 20 such as shown and described in U.S. Pat. No. 3,401,749 issued to Daniel, U.S. Pat. No. 3,791,447 issued to Smith, et al., and U.S. Pat. No. 3,722,594 issued to Smith, et al., each of which is incorporated herein by reference.

The lowermost or distal end portion 22 of tubing string 14 attaches to carrying tool 30. The connection of carrying tool 30 and the lowermost 22 end portion of tubing string 14 is best seen in FIGS. 2 and 3. The end 22 portion of tubing string 14 provides a plurality of outer threads 24 which form a threaded connection with a corresponding set of female threads 26 upon tool carrier 30. Tool carrier 30 provides an uppermost open bore which is occupied by the end portion 22 of coil tubing 14 between 27 and 28 as indicated in FIG. 2. The uppermost portion of carrier 30 thus provides an open, generally cylindrical bore 32 which is occupied by the end portion 22 of tubing 14 between positions 27 and 28. The bore 32 is of an internal diameter substantially equal to the outside diameter of tubing string 14. When threads 24, 26 are threadably engaged, a plurality of set screws 34–37 can be tightened to form a further structural attachment between tubing string 14 and tool carrier 30. The lowermost end portion of tool carrier 30, designated as 32 in the drawings, provides another threaded section 34 having female threads which can engage the threads 42 of sub 40. Sub 40 can, for example, be provided with threads 44 at its opposite end portion from threads 42 of a different thread configuration so that a universal connection between tool carrier 30 and any number of wire-line type tools can be attached to the tool carrier 30 by means of subs 40 having threads 42 which attach to the tool carrier at 34 and having threads 44 which attach to any desired tool to be run into the well bore WB. It has been found that the above described arrangement allows a substantial amount of force to be applied to the tool carrier and thus to the tool being supported thereby, such as for example, a minimum line pull of 14,000 lbs. and a maximum line pull of 20,000 lbs. This arrangement allows the running of a plurality of diverse hollow internally bored tools such as wire-line type tools, such as for example, jars, fishing tools, pulling tools, running tools, and/or off/on overshots. Other tools include a catch and releaseable spear, a catch and releaseable overshot, and/or numerous drills which can be supported from subs for example, or directly by the carrying tool.

Figure 4:
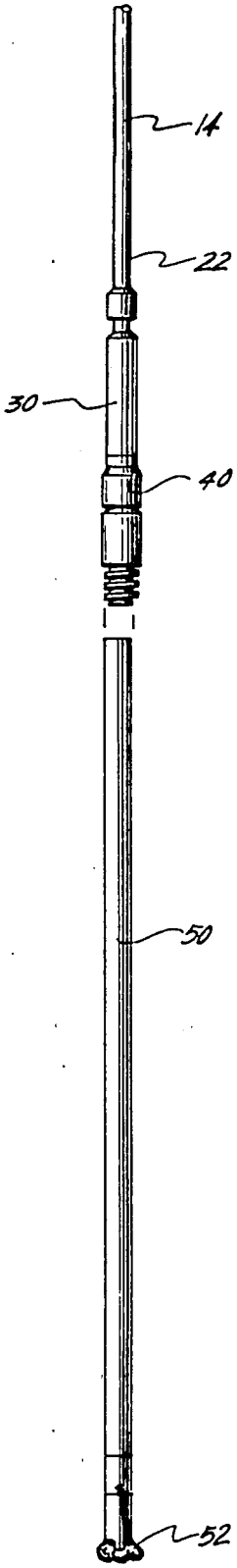
FIG. 4 is an elevational view of the preferred embodiment of the apparatus of the present invention illustrating an assembly of the coil tubing, the carrying tool, a sub, and a drill.
Figure 5:
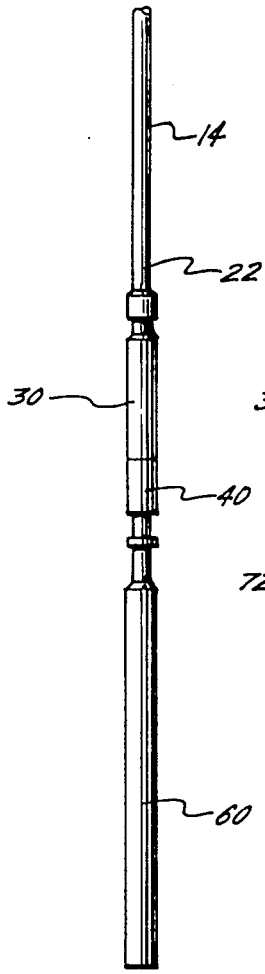
FIG. 5 is an elevational view of the preferred embodiment of the apparatus of the present invention showing an assembly of a coil tubing string, the carrying tool, as used within a pulling tool or an off/on overshot.

The FIGS. 4–7 illustrate a number of exemplary uses of carrying tool 30 as part of the overall embodiment 10 of the apparatus of the present invention. In FIG. 4 there can be seen the lower 22 distal end portion of coil tubing string 14 attached to carrying tool 30. The lowermost end portion of tool 30 is attached to a sub 40 having threads which would accept, for example, a one inch NPTX thread for supporting an elongated drill 50 (such as a down hole motor such as manufactured by DynaDrill) having a bit 52. In FIG. 5, coil tubing string 14 supports at its lower end 22 carrying tool 30 to which is attached sub 40 and a wire-line type tool which has been bored to allow fluid flow therethrough, such as for example an on/off overshot 60 such as manufactured by Baker Oil Tools but modified with a fluid circulating internal bore.

Figure 6:
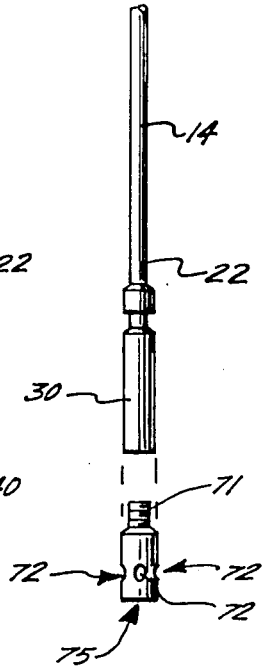
FIG. 6 is an elevational view of the preferred embodiment of the apparatus of the present invention illustrating the coil tubing string, the carrying tool.

In FIG. 6, carrying tool 30 is connected to a sub 70 having a plurality of radially spaced ports 72 which communicate with an internal bore of the sub 70. The sub 70 has an upper set of threads 71 which threadably attach to the carrying tool 30. Use of sub 70 allows circulation when running wire-line tools which do not have a hollow internal bore allowing circulation to a position adjacent the wire-line tool being run so that the circulating fluid can wash away debris in the well bore from the position of discharge of fluid through ports 72 and adjacent the wire-line tool assembly attached to sub 70. Thus, any wire-line tool can be connected by means of, for example female threads 78 at the lower 75 portion of sub 70 and on the internal bore 77 thereof. The sub 70 allows any wire-line tools (even those without a flow bore) to be run in the hole on the coil tubing string 14.

Figure 7:
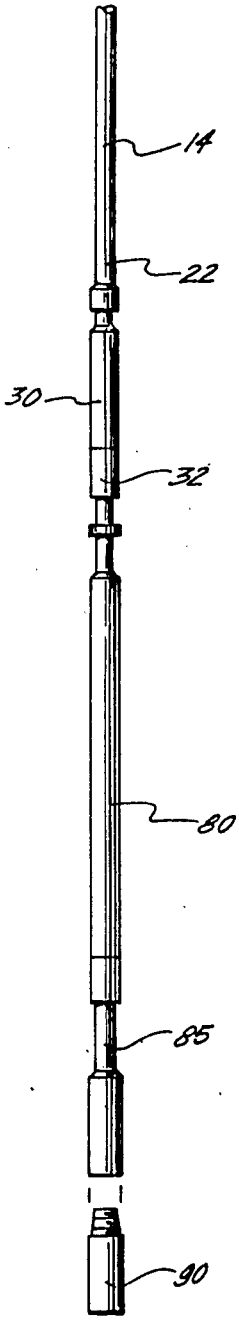
FIG. 7 is an elevational view of the preferred embodiment of the apparatus of the present invention illustrating an assembly of the coiled tubing string, the carrying tool, and overshot or wire-line pulling/running tool.
Figure 6A:
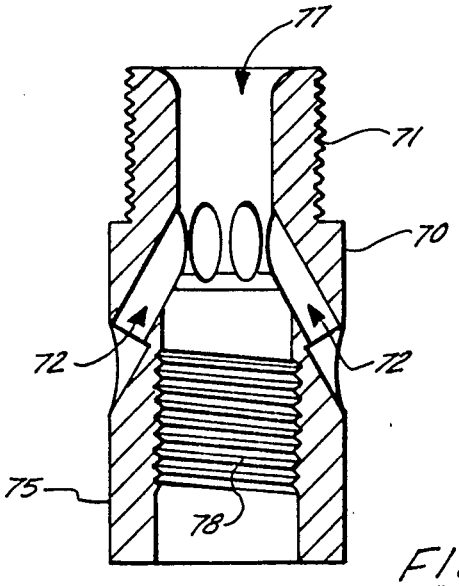
FIG. 6A is a cross-sectional view of a sub for running non-hollow internal wire-line tools.

FIG. 7 illustrates the use of a jar and accelerator assembly 80 as run in the well by means of carrying tool 30 supported on coil tubing string 14. The lowermost portion of jar and accelerator assembly 80 is attached to an off/on releaseable overshot 85 which can be form an attachment to any tool 90 which is lost in the well and must be retrieved. Such jars and accelerators are manufactured under the trademark "Taylor-Jar." Another tool assembly that can be run with this method is a releaseable spear.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as the invention is:

1. A method for running tools in an oil or gas well on coil tubing, comprising:

a. running an elongated small diameter tubing string with an unobstructed open flow bore from a coil stored on a reel down an oil/gas well forming a work string;

b. securing as fluid conveying tool carrier to the distal end of the coil tubing string so that fluid can circulate from the coil tubing on the reel through the unobstructed open flow bore and into the tool carrier;

c. introducing pressurized gas into the well through the unobstructed open flow bore of the tubing so that it circulates through the tubing and then the tool carrier; and d. supporting a tool assembly with the tool carrier so that tension in the excess of 14,000 lbs. can be applied to the tool assembly with the coil tubing work string for operating a tool supported by the tool carrier using pressure applied to the tool assembly and tool carrier with the tubing work string.

2. The method of claim 1, wherein the tool is a wire-line tool.

3. The method of claim 1, wherein the tool includes mechanical means operable by tension or compression applied through the coil tubing string for forming a connection with an object that has become at least temporarily lost in the well.

4. The method of claim 1, wherein the string is thrust into the well by rotation of the reel.

5. The method of claim 2, wherein the tool is an overshot.

6. The method of claim 1 further comprising the step of applying a force to the tool by the injector head to move the tool through the well.

7. The method of claim 6 further comprising the step of simultaneously pumping pressurized fluid from the coil tubing, through the carrying tool to aid in moving the tool through material accumulated in the well.

* * * * *